US011808185B2

(12) United States Patent
Sliwa

(10) Patent No.: US 11,808,185 B2
(45) Date of Patent: Nov. 7, 2023

(54) ENGINE WITH CYLINDER CRANKCASE AND OIL RETURN COLLECTION CHANNEL AND OIL DRAIN

(71) Applicant: DEUTZ Aktiengesellschaft, Cologne (DE)

(72) Inventor: Marco Sliwa, Siegburg (DE)

(73) Assignee: Deutz Aktiengesellschaft, Cologne (DE)

( * ) Notice: Subject to any disclaimer, the term of this patent is extended or adjusted under 35 U.S.C. 154(b) by 0 days.

(21) Appl. No.: 17/802,988

(22) PCT Filed: Feb. 25, 2021

(86) PCT No.: PCT/EP2021/000021
§ 371 (c)(1),
(2) Date: Aug. 29, 2022

(87) PCT Pub. No.: WO2021/175485
PCT Pub. Date: Sep. 10, 2021

(65) Prior Publication Data

US 2023/0115612 A1 Apr. 13, 2023

(30) Foreign Application Priority Data

Mar. 2, 2020 (DE) ..... 102020001339.2

(51) Int. Cl.

| | |
|---|---|
| ***F01M 11/02*** | (2006.01) |
| ***F02B 75/18*** | (2006.01) |
| ***F01M 13/04*** | (2006.01) |
| *F01M 11/00* | (2006.01) |

(52) U.S. Cl.
CPC ..... *F01M 11/02* (2013.01); *F01M 13/04* (2013.01); *F02B 75/18* (2013.01); *F01M 11/0004* (2013.01)

(58) Field of Classification Search
CPC .... F01M 11/02; F01M 13/04; F01M 11/0004; F02B 75/18
See application file for complete search history.

(56) References Cited

U.S. PATENT DOCUMENTS 4,545,112 A * 10/1985 Holmberg ..... H01L 29/78696 257/E29.291
6,101,994 A * 8/2000 Ichikawa ..... F02F 1/108 123/41.72

(Continued)

FOREIGN PATENT DOCUMENTS

DE 197 29971 C1 10/1998
DE 19729971 C1 * 10/1998 ..... F01M 11/02
DE 19754008 C2 4/2003

(Continued)

OTHER PUBLICATIONS

International Search Report for PCT/EP2021/000021, dated Aug. 7, 2021.

*Primary Examiner* — Syed O Hasan
(74) *Attorney, Agent, or Firm* — Davidson, Davidson & Kappel, LLC

(57) ABSTRACT

An internal combustion engine, in particular, a diesel internal combustion engine, including a cylinder crankcase (1), at least one oil return collection groove (2), at least one oil drain (3), in which depressurized oil (4) discharges in the direction of the oil pan, following gravity, and at least one cylinder (5) is provided.

4 Claims, 1 Drawing Sheet

(56) References Cited

U.S. PATENT DOCUMENTS

| | | | | |
|---|---|---|---|---|
| 9,739,231 | B2 * | 8/2017 | Pegg | F02F 1/10 |
| 2015/0034029 | A1 | 2/2015 | Obenaus et al. | |

FOREIGN PATENT DOCUMENTS

| | | | |
|---|---|---|---|
| DE | 100 26113 | B4 | 7/2013 |
| DE | 102015101410 | A1 | 8/2016 |
| EP | 0 928891 | A2 | 7/1999 |
| JP | 2010 196565 | A | 9/2010 |
| JP | 2016102459 | A | 6/2016 |
| TW | 201132846 | A | 10/2011 |
| TW | 20 243145 | A | 11/2012 |
| TW | 201243145 | A | 11/2012 |
| WO | WO 2012175275 | A1 | 12/2012 |

* cited by examiner

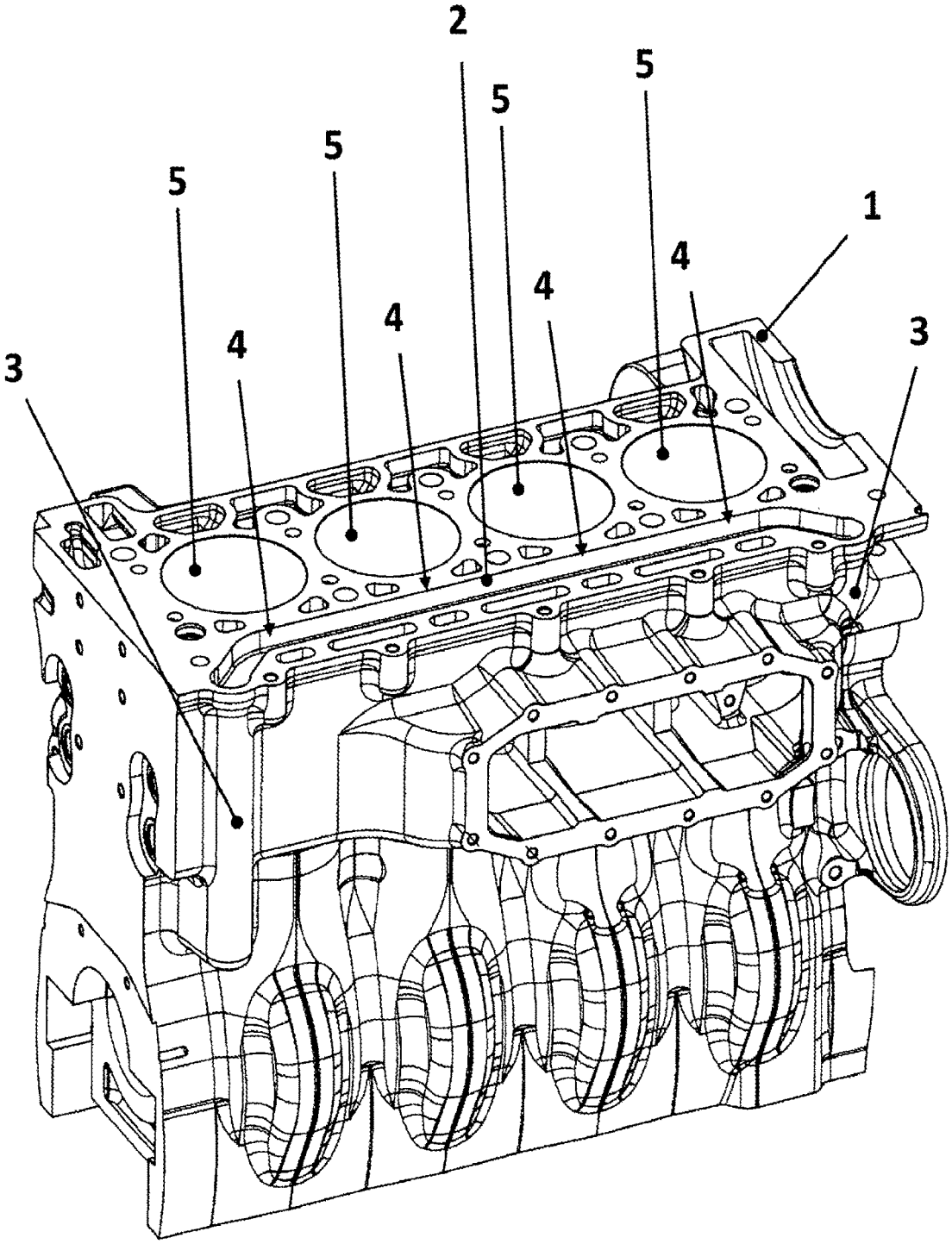
2
5
5
5
5
1
4
4
4
4
3
3

ENGINE WITH CYLINDER CRANKCASE AND OIL RETURN COLLECTION CHANNEL AND OIL DRAIN

The present disclosure relates to an engine including a cylinder crankcase and an oil return collection groove and oil drains.

BACKGROUND

An internal combustion engine is known from DE 102015101410 A1, including a cylinder crankcase, an oil pan, which during operation is filled with oil up to an oil level, an oil pan upper part including at least one passage aperture and an oil return, which includes at least one oil channel and which is used to return oil, in particular, from the oil separation, into the oil pan.

DE 100 26 113 B4 shows an internal combustion engine including an oil pan upper part, which is situated between a crank pit and an oil pan and which is held between a cylinder crankcase and an adjoining portion of an oil pan. An oil channel extends in such a way that the oil returned from the cylinder head is conducted into the oil pan below the oil level.

A reciprocating piston internal combustion engine is known from DE 19754008 C2, including a cylinder head accommodating valves as gas exchange control elements and a crankcase accommodating a crankshaft, in which the cylinder head and the crankcase, made up of a crankcase upper part and a crankcase lower part, are continuously braced with respect to one another with the aid of tie rods, which are anchored in the lower area of the cylinder head facing the crankcase and which are braced in the area of the crankcase lower part against bearing blocks forming bearing receptacles of the crankshaft, the crankcase lower part having a double-walled design and, for delimiting the sump, including a sump bottom surrounding the bearing blocks, from which an outer crankcase bottom is situated spaced apart, and the crankcase bottom, in the area of boreholes for the tie rods which extend through the bearing blocks, being drawn in toward the sump bottom, in such a way that the screw elements associated with the tie rods are situated in receptacles drawn in in a pocket-shaped manner which are delimited by the bearing blocks.

In WO 2012175275 A1, an oil gallery is situated in the area of the cylinder head of the head-block unit, from which a supply borehole to a lubricant supply channel leads to the bearing bushing of the shaft of the exhaust gas turbocharger. A transfer opening for the oil return and the sealing air discharge, which opens into the lubricant return channel, is situated in the flange of the exhaust gas turbocharger. The lubricant return channel, which may also be drilled and closed by a screw plug or a core hole plug, leads via the vertical portion of the return line back into the oil pan.

SUMMARY

Very high importance is attached to compactness during the development of engines. It is crucial to represent as many functions as possible in a small installation space. Today's designs show cylinder crankcases including individual oil drains for each cylinder, which allow the depressurized oil to flow into the engine block, and later back into the oil pan.

One alternative could be fewer oil drains and a combination of depressurized oil volumes in the cylinder head.

This variant has the disadvantage that the cylinder head is weakened in its structure in the area where the oil from two or multiple cylinders merges.

In the process, it is disadvantageous that the individual oil drains in the cylinder crankcase take up a lot of space or the structure is weakened.

It is an object of the present disclosure to avoid the above-described disadvantages and to create a compact and stable engine.

The present disclosure provides an internal combustion engine, in particular, a diesel internal combustion engine, including a cylinder crankcase (1), at least one oil return collection groove (2), at least one oil drain (3), in which depressurized oil (4) discharges in the direction of the oil pan, following gravity, and at least one cylinder (5). The present disclosure is described in greater detail hereafter based on the figure.

BRIEF DESCRIPTION OF THE DRAWINGS

FIG. 1 shows an internal combustion engine according to the present disclosure with a view onto the crankcase open at the top.

DETAILED DESCRIPTION

The present design shows many functions in a small installation space, which does not weaken the structure of the cylinder head at the same time. In the approach shown in FIG. 1, depressurized oil 4 is transferred from the cylinder head of each cylinder 5 to cylinder crankcase 1 in such a way that it is transferred in the one oil return collection groove 2 situated horizontally in the area of the separation plane between the head and the block. In this way, the construction of a clean structure in the cylinder, without limitations, is possible. An oil return collection groove 2 is cast or machined into cylinder crankcase 1. Oil return collection groove 2 merges the depressurized oil from the individual cylinder areas of the cylinder head, collects it and conducts it onward to cast-on or machined-on oil drains 3, which are vertically situated in the area of the first and last cylinders, in the direction of the oil pan. In this way, space is created beneath the oil return collection groove 2 for water channels and for further modules to be provided, such as, for example, cooling cassettes or the like.

LIST OF REFERENCE NUMERALS

1 cylinder crankcase
2 oil return collection groove
3 oil drain
4 depressurized oil
5 cylinder

What is claimed is:

1. An internal combustion engine comprising a cylinder crankcase;

a cylinder head;

multiple cylinders including a first cylinder and a last cylinder;

at least one oil return collection groove essentially situated in an area of a separation lane of the cylinder crankcase and the cylinder head and extending from the first cylinder to the last cylinder; and two vertically situated oil drains each in an area of a respective one of the first and last cylinders, the two vertically situated oil drains configured for discharging depressurized oil in a direction of an oil pan, following gravity, wherein the at least one oil return collection groove merges the depressurized oil from the individual cylinder areas of the cylinder head, collects the oil and conducts the oil onward to the oil drains in the area of the first cylinders and the last cylinders.

2. The internal combustion engine as recited in claim 1, wherein the oil return collection groove is essentially horizontally situated.

3. The internal combustion engine as recited in claim 1, wherein the oil return collection groove is recessed into a top planar surface of the cylinder crankcase and extends continuously along the top planar surface such that a first end of the oil return collection groove is longitudinally past the first cylinder and a second end of the oil return collection groove is longitudinally past the last cylinder.

4. The internal combustion engine as recited in claim 1, wherein the oil return collection groove is recessed into a top planar surface of the cylinder crankcase and extends continuously along the top planar surface such that a first end of the oil return collection groove protrudes laterally away from the first cylinder and a second end of the oil return collection groove protrudes laterally away from the last cylinder.

* * * * *